US006740361B1

(12) United States Patent
Bibber

(10) Patent No.: US 6,740,361 B1
(45) Date of Patent: May 25, 2004

(54) PASSIVATING OF ZINC SURFACES

(75) Inventor: John W. Bibber, Batavia, IL (US)

(73) Assignee: Sanchem, Inc., Chicago, IL (US)

( * ) Notice: Subject to any disclaimer, the term of this patent is extended or adjusted under 35 U.S.C. 154(b) by 0 days.

(21) Appl. No.: 10/230,718

(22) Filed: Aug. 29, 2002

(51) Int. Cl.[7] ..... B05D 1/38; B05D 7/14

(52) U.S. Cl. ..... 427/388.1; 427/419.1; 148/243; 148/253; 148/441

(58) Field of Search ..... 427/419.1, 388.1; 148/441, 243, 253

(56) References Cited

U.S. PATENT DOCUMENTS 4,385,940 A * 5/1983 Kirihara et al. ..... 148/6.15 R

FOREIGN PATENT DOCUMENTS

FR 1125084 * 10/1956

JP 55-018532 * 2/1980

OTHER PUBLICATIONS

Wilcox et al, Metal Finishing, 86(9), pp 71–74, 1988.*

Kong et al, Cailiao Baohu, 34(11), pp 7–9, 2001.*

Wang et al, Yingyong Huaxue, 13(5), pp 73–75, 1996.*

Chen et al, Diandu Yu Huanbao, 20(1), pp 21–24, 2000.*

* cited by examiner

*Primary Examiner*—Erma Cameron
(74) *Attorney, Agent, or Firm*—James B. Conte; Barnes & Thornburg

(57) ABSTRACT

A method for coating zinc or zinc plated article with a polymerized molybdate protective coating by coating a cleaned zinc or zinc plated article with a chromium-free polymerized molybdate composition having a pH of about 1.0 to 5.0. A passified zinc or zinc plated article having coated thereon a polymerized molybdate composition that will allow the article to be painted with an appropriate paint.

8 Claims, No Drawings

PASSIVATING OF ZINC SURFACES

FIELD OF INVENTION

This invention relates to a zinc coating composition and a method of providing zinc with a protective coating. More particularly, the present invention provides a zinc coating composition having as its essential ingredient the isopoly and heteropolymolybdate acids and alkali metal and ammonium salts thereof at a pH that ranges from 1.0 to 5.0. The isopolymolybdate acids consist of clusters of seven or eight molybdenum atoms and associated hydrogen and oxygen atoms. The heteropolymolybdate acids consist of a cluster of seven or eight molybdenum atoms, hydrogen, oxygen and one or two atoms of another element.

BACKGROUND OF INVENTION

Untreated zinc metal quickly develops a white film of zinc oxide or hydroxide. These corrosion products will cause many deleterious effects. For example, zinc oxide prevents paint from adhering to the metal. In addition, the oxide accelerates further corrosion of the metal.

Passivating the metal prevents the formation of zinc oxide or hydroxide (see British patent No. 592,073; Wendorff, Z., Zolnierowicz, A.; Ochronaprzed Korozja, 13,1 (1970); Ostrander, G. W.; Plating, 38,1033 (1951); and British patent No. 594,699). Typical passivating solutions utilize a dichromate or chromate composition. The composition is generally applied to the metal via immersion (see Fishlock, D. J.; "Product Finishing", 12, 87 (1959). Increasing immersion times up to 300 seconds will generally produce a more effective coating. Immersion times beyond 300 seconds typically do not produce more effective coatings. An untreated surface will show signs of corrosion after 0.5 hours of exposure to a neutral salt spray according to ASTM specification "B 117" and a thin chromate film produced by a dip procedure will show signs of corrosion after 12 to 24 hours of salt spray exposure (see; ASTM-"B201").

Reliance on hexavalent chromium has many drawbacks. Hexavalent chromium is extremely toxic and as such more costly to work with. For instance, hexavalent chromium will require special disposal procedures. I have a unique chromium-free zinc coating composition which is superior, in part, because it does not have the toxicity and cost associated with hexavalent chromium. My zinc coating composition utilizes isopoly and/or heteropolymolybdates as its essential ingredients.

SUMMARY OF INVENTION

The present invention concerns a method for the coating of zinc or zinc coated articles with a composition containing isopolymolybdate or heteropolymolybdate acids, or a mixture of them, at a pH of about 5.0 to 1.0. This invention also concerns a passified zinc or zinc coated article having coated thereon a chromium-free polymolybdate acid protective coating.

Another aspect of the invention is directed at a chromium-free polymolybdate coating composition for coating zinc or zinc plated articles.

Still another aspect of this invention is directed at a manufacture of an article of zinc or zinc coated material having a polymolybdate protective coating thereon.

DETAILED DESCRIPTION

The present invention may be further understood with reference to the following description and examples.

The present invention eliminates the need for hexavalent chromium compositions which, due to their extreme toxicity, are being forced out of the work place environment. In addition, the invention provides substantially the same high level of paint adhesion and corrosion resistance as that given by hexavalent chromium compositions of the same relative thickness. While at the same time being considerably less toxic. Very little toxic waste is produced and thus very little needs to be disposed of.

Accordingly, this invention provides a protective coating for zinc and zinc plated surfaces which have as its essential ingredients isopolymolybdate acid and/or heteropolymolybdate acids. The concentration of polymolybdic acids necessary to form a film of sufficient thickness to be effective is not less then 0.25 grams per liter. The upper limit of concentration is the saturation point of the polymolybdic acid in question.

Although my pH range is 1.0 to 5.0, the most suitable pH range is 1.5 to 4.5. At a pH of 1.0 to 1.5 or below, the zinc is strongly attacked and will have more of a tendency to go into solution then form an insoluble zinc-polymolybdate film. At a pH of 4.5 to 5.0 and above, the concentration of the polymolybdate acids is too small to form a thick enough film. Therefore, the most preferred range is a pH of 2.0 to 4.0. The pH is adjusted and maintained within the proper range by the addition of an acid or a base as required. Nitric acid is preferred as it gives a cleaner surface. The first thirteen examples refer to the isopolymolybdate acids which consist of a cluster of seven or eight molybdate ions which are generated in solution by proper adjustments of the pH of a sodium molybdate solution. The molybdate salt of any of the alkali metal elements or that of the ammonium salt may be used if so desired. Example 1 illustrates the presence of too low a concentration of a polymolybdate acid due to too high a pH. Example 13 illustrates the presence of too low a concentration of polymolybdate acid due to too low a concentration of molybdate ions. Example 8 illustrates the effect of too low a pH.

Examples 14–17 reference the heteropolymolybdates.

Example 14 is an example of a non transition metal heteropolymolybdate.

Although aluminum is illustrated, other non-transition metals may be used as long as they are not detrimental to the zinc.

Example 15 is an example of a first row transition metal heteropolymolybdate. Although manganese is illustrated, other transition metals may be used as long as they are not detrimental to the zinc.

Example 16 is an example of a non-metal heteropolymolybdate. Although phosphorous is illustrated, other non-metals may be used as long as they are not detrimental to the zinc.

Example 17 illustrates the paint adhesion characteristics of the coating.

The following examples are used to illustrate the invention and are not intended to limit the scope of the invention. In the examples, zinc plated steel surface or a pure zinc panel was cleaned of oils and/or loose soil with a non-ionic detergent. The cleaned zinc surface was then made the cathode of an electrolytic cell of 12 volts and 10 amps for 30 seconds in a 2.5 gram per liter sodium carbonate solution to obtain an oxide free and reactive zinc surface. The clean and active surface was immediately rinsed in D.I. water and chemically treated as indicated in the example in question. The metal panels used were three inches by five inches and one sixteenth of an inch thick.

EXAMPLE 1

A 10.0 gram per liter solution of sodium molybdate two hydrate was adjusted to pH of 6.0 by the controlled addition of nitric acid. A cleaned and activated zinc panel placed in the solution at ambient temperature for ten minutes showed no change in color or increase in salt spray (according to ASTM B117) corrosion resistance over that of the bare metal when rinsed in D.I. water, dried for eight hours and placed in a standard salt spray cabinet.

EXAMPLE 2

A 10.0 gram per liter solution of sodium molybdate two hydrate was adjusted to pH of 5.0 by the controlled addition of nitric acid. A cleaned and activated zinc panel placed in the solution at ambient temperature for ten minutes became light gray in color and withstood two hours of a standard salt spray exposure (according to ASTM B117) when rinsed in D.I. water and dried for eight hours before being exposed to the salt spray.

EXAMPLE 3

A 10.0 gram per liter solution of sodium molybdate two hydrate was adjusted to pH of 4.5 by the controlled addition of nitric acid. A cleaned and activated zinc panel placed in the solution at ambient temperature for three minutes became black in color and withstood ten hours of a standard salt spray exposure (according to ASTM B117) when rinsed in D.I. water and dried for eight hours before being exposed to the salt spray.

EXAMPLE 4

A 10.0 gram per liter solution of sodium molybdate two hydrate was adjusted to pH of 3.0 by the controlled addition of nitric acid. A cleaned and activated zinc panel placed in the solution at ambient temperature for three minutes became black in color and withstood twelve hours of a standard salt spray exposure (according to ASTM B117) when rinsed in D.I. water and dried for eight hours before being exposed to the salt spray.

EXAMPLE 5

A 10.0 gram per liter solution of sodium molybdate two hydrate was adjusted to pH of 2.5 by the controlled addition of nitric acid. A cleaned and activated zinc panel placed in the solution at ambient temperature for three minutes became black in color and withstood fourteen hours of a standard salt spray exposure (according to ASTM B117) when rinsed in D.I. water and dried for eight hours before being exposed to the salt spray.

EXAMPLE 6

A 10.0 gram per liter solution of sodium molybdate two hydrate was adjusted to pH of 2.0 by the controlled addition of nitric acid. A cleaned and activated zinc panel placed in the solution at ambient temperature for three minutes became black in color and withstood twelve hours of a standard salt spray exposure (according to ASTM B117) when rinsed in D.I. water and dried for eight hours before being exposed to the salt spray.

EXAMPLE 7

A 10.0 gram per liter solution of sodium molybdate two hydrate was adjusted to pH of 1.5 by the controlled addition of nitric acid. A cleaned and activated zinc panel placed in the solution at ambient temperature for three minutes became black in color and withstood eight hours of a standard salt spray exposure (according to ASTM B117) when rinsed in D.I. water and dried for eight hours before being exposed to the salt spray.

EXAMPLE 8

A 10.0 gram per liter solution of sodium molybdate two hydrate was adjusted to pH of 1.0 by the controlled addition of nitric acid. A cleaned and activated zinc panel placed in the solution at ambient temperature evolved hydrogen gas and would only acquire a light gray color after three minutes of exposure. The panel withstood two hours of a standard salt spray exposure (according to ASTM B117) when rinsed in D.I. water and dried for eight hours before being exposed to the salt spray.

EXAMPLE 9

A 10.0 grain per liter solution of sodium molybdate two hydrate was adjusted to pH of 3.0 by the controlled addition of nitric acid. A cleaned and activated zinc plated steel panel was placed in the solution at ambient temperature for three minutes became black in color and withstood twelve hours of a standard salt spray exposure (according to ASTM B117) when rinsed in D.I. water and dried for eight hours before being exposed to the salt spray.

EXAMPLE 10

A 10.0 gram per liter solution of sodium molybdate two hydrate was adjusted to pH of 3.0 by the controlled addition of sulfuric acid. A cleaned and activated zinc panel placed in the solution at ambient temperature for three minutes became black in color and withstood twelve hours of a standard salt spray exposure (according to ASTM B117) when rinsed in D.I. water and dried for eight hours before being exposed to the salt spray.

EXAMPLE 11

A 10.0 gram per liter solution of sodium molybdate two hydrate was adjusted to pH of 3.0 by the controlled addition of nitric acid. A cleaned and activated zinc panel placed in the solution at 150 degrees F. temperature for one minute became black in color and withstood twelve hours of a standard salt spray exposure (according to ASTM B117) when rinsed in D.I. water and dried for eight hours before being exposed to the salt spray.

EXAMPLE 12

A 200 gram per liter solution of sodium molybdate two hydrate was adjusted to pH of 3.0 by the controlled addition of nitric acid. A cleaned and activated zinc panel placed in the solution at ambient temperature for one minute became black in color and withstood twelve hours of a standard salt spray exposure (according to ASTM B117) when rinsed in D.I. water and dried for eight hours before being exposed to the salt spray.

EXAMPLE 13

A 0.38 gram per liter solution of sodium molybdate two hydrate (equivalent to 0.25 grams of isopolymolybdate acid) was adjusted to pH of 3.0 by the controlled addition of nitric acid. A cleaned and activated zinc panel placed in the solution at ambient temperature for three minutes became light gray in color and withstood two hours of a standard salt spray exposure (according to ASTM B117) when rinsed in D.I. water and dried for eight hours before being exposed to the salt spray.

EXAMPLE 14

A 10.0 gram per liter solution of sodium molybdate two hydrate was adjusted to pH of 2.5 by the controlled addition of nitric acid and 2.59 grams of aluminum nitrate nine hydrate in order to produce the aluminum heteropolymolybdate salt. A cleaned and activated zinc panel placed in the solution at ambient temperature for three minutes became black in color and withstood thirteen hours of a standard salt spray exposure (According to ASTM B117) when rinsed in D.I. water and dried for eight hours before being exposed to the salt spray.

EXAMPLE 15

A 10.0 gram per liter solution of sodium molybdate two hydrate was adjusted to pH of 3.0 by the controlled addition of nitric acid and 1.32 grams of manganese nitrate six hydrate to generate the manganese heteropolymolybdate acid. A cleaned and activated zinc panel placed in the solution at ambient temperature for three minutes became black in color and withstood twelve hours of a standard salt spray exposure (according to ASTM B117) when rinsed in D.I. water and dried for eight hours before being exposed to the salt spray.

EXAMPLE 16

A 10.0 gram per liter solution of sodium molybdate two hydrate was adjusted to pH of 3.0 by the controlled addition of phosphoric acid in order to generate the heteromolybdate acid phosphate complex. A cleaned and activated zinc panel placed in the solution at ambient temperature for three minutes became brown in color and withstood two hours of a standard salt spray exposure (according to ASTM B117) when rinsed in D.I. water and dried for eight hours before being exposed to the salt spray.

EXAMPLE 17

A 10.0 gram per liter solution of sodium molybdate two hydrate was adjusted to pH of 3.0 by the controlled addition of phosphoric acid in order to generate the heteromolybdate acid phosphate complex. A cleaned and activated zinc panel placed in the solution at ambient temperature for three minutes became brown in color. The panel was then removed; rinsed in D.I. water, dried at ambient temperature and coated with a standard epoxy-polyamide primer and top coat. After proper curing of the primer and top coat the adhesion of the coating was tested according to the ASTM D 3359 standard, on a cross hatched surface, both before and after exposure to 168 hours of neutral salt spray according to the ASTM B 117 standard. In both cases the adhesion was rated a "4B" or excellent.

What is claimed is:

1. A method for coating zinc or zinc plated article with a protective coating comprising coating a cleaned zinc or zinc plated article with a polymerized molybdate composition having a pH of about 1.0 to about 5.0, said polymerized molybdate composition has a polymolybdate concentration of at least 0.25 grams per liter, said polymerized molybdate composition has a metal that combines with the molybdate and said metal is selected from the group consisting of aluminum, manganese, cobalt, tin, cerium, and mixtures thereof.

2. The method of claim 1, wherein the pH of the polymerized molybdate composition is about 2.0 to 4.0.

3. The method of claim 2, wherein the polymerized molybdate is selected from the group consisting of isopolymolybdate, heteropolymolybdate and mixtures thereof.

4. The method of claim 3, wherein the polymerized molybdate has paramolybdate and/or octanalybdate ion.

5. The method of claim 4, wherein the pH is controlled by nitric acid.

6. The method of claim 3, wherein the pH is controlled by phosphoric acid and the polymerized molybdate is heteropolymolybdate.

7. A method for coating zinc or zinc plated article with a protective coating comprising coating a cleaned zinc or zinc plated article with a polymerized molybdate composition having a pH of about 1.0 to about 5.0, said polymerized molybdate composition has a polymolybdate concentration of at least 0.25 grams per liter, drying the polymolybdate coated zinc or zinc plated article, and painting the dried polymolybdate zinc or zinc plated article to provide a paint protected zinc or zinc plated article that will pass the ASTM-D3359 paint adhesion test.

8. The method of claim 7, wherein the pH of the polymerized molybdate composition is about 2.0 to 4.0.

* * * * *